United States Patent [19]

Agatahama et al.

[11] Patent Number: 4,587,501

[45] Date of Patent: May 6, 1986

[54] POLARIZED ELECTROMAGNETIC RELAY

[75] Inventors: Shunichi Agatahama, Osaka; Shoichi Yamashita, Nagaokakyo, both of Japan

[73] Assignee: Omron Tateisi Electronics Co., Kyoto, Japan

[21] Appl. No.: 603,011

[22] Filed: Apr. 23, 1984

[30] Foreign Application Priority Data

Apr. 22, 1983 [JP] Japan ..... 56-61262[U]

[51] Int. Cl.[4] ..... H01H 51/22

[52] U.S. Cl. ..... 335/80; 335/78; 335/202

[58] Field of Search ..... 335/78–85, 335/202

[56] References Cited

U.S. PATENT DOCUMENTS 3,993,971 11/1976 Ono et al. ..... 335/78

*Primary Examiner*—Harold Broome

*Attorney, Agent, or Firm*—Schwartz, Jeffery, Schwaab, Mack, Blumenthal & Evans

[57] ABSTRACT

A polarized electromagnetic relay having four sets of single-pole double-through contact switches comprises a coil spool wound with a coil, a bar-like core inserted in the coil spool, an elongated yoke extending in parallel with the core and having two pairs of laterally opposing erect legs at both ends thereof, respectively, wherein the pole ends of the core are disposed, respectively, between the paired erect leg. A pair of movable armatures each composed of a permanent magnet having pole pieces at both sides are so disposed between the paired erect legs of the yoke, respectively, that the pole end of the core is positioned between the pole pieces of the permanent magnet. The pair of the armatures are slideably supported on guide means formed in end collars of the coil spool so that the armatures can move independent of each other. The relay exhibits high sensitivity with a miniaturized structure and assures reliable switching operations.

6 Claims, 1 Drawing Figure

POLARIZED ELECTROMAGNETIC RELAY

BACKGROUND OF THE INVENTION

1. Field of the Invention

The present invention generally relates to a polarized electromagnetic relay. In particular, the invention concerns an improvement on or relating to the polarized electromagnetic relay of a miniature size which enjoy a high package density and is suited for use in combination with a printed circuit.

2. Description of the Prior Art

There is known an electromagnetic actuator used in a polarized relay. This electromagnetic actuator comprises an iron core of a generally U-shape wound with an electromagnetic coil and has two legs in which magnetic poles of opposite polarities are produced, respectively; a pair of elongated movable pole plates being diposed to extend in parallel with each other, and between which a pair of juxtaposed permanent magnets are fixedly sandwiched for constituting a rotatably movable magnetic block of the electromagnetic actuator having air gaps at both ends and positioned in a manner that said legs of the core are disposed within air gaps of said magnetic block.

The electromagnetic actuator above described suffers from such drawbacks that because the permanent magnets are connected in parallel with the core, the magnetic flux running through the core is disadvantageously divided into halves at the contacting portions between the pole plates and the magnetic poles.

SUMMARY OF THE INVENTION

It is therefore an object of the present invention to provide an improved structure of the polarized electromagnetic relay which is capable of solving the problems of the hitherto known polarized relays such as low utilization efficiency of the magnetomotive force of the permanent magnet.

In view of the above object, it is proposed according to a feature of the present invention that slideably supporting means is provided for each of the movable magnetic blocks or armatures.

According to an aspect of the present invention, there is provided a polarized electromegnetic relay which comprises an elongated yoke having at each end a pair of erect legs widthwise opposing to each other, a bar-like core extending substantially in parallel with the yoke, a coil wound on the core, and a pair of movable armatures each composed of a permanent magnet and pole pieces disposed at both ends of the permanent magnet perpendicularly to the direction of magnetization of the permanent magnet, wherein each end portion of the core is disposed between the erect legs in pairs, respectively, to thereby define four working gaps in total, the pair of the magnet poles of the armature being disposed in each pair of the working gaps, and each of the armatures being slideably supported by guide means disposed in the direction orthogonal to the center axis of the core.

DESCRIPTION OF THE PREFERRED EMBODIMENTS

Figure 1:
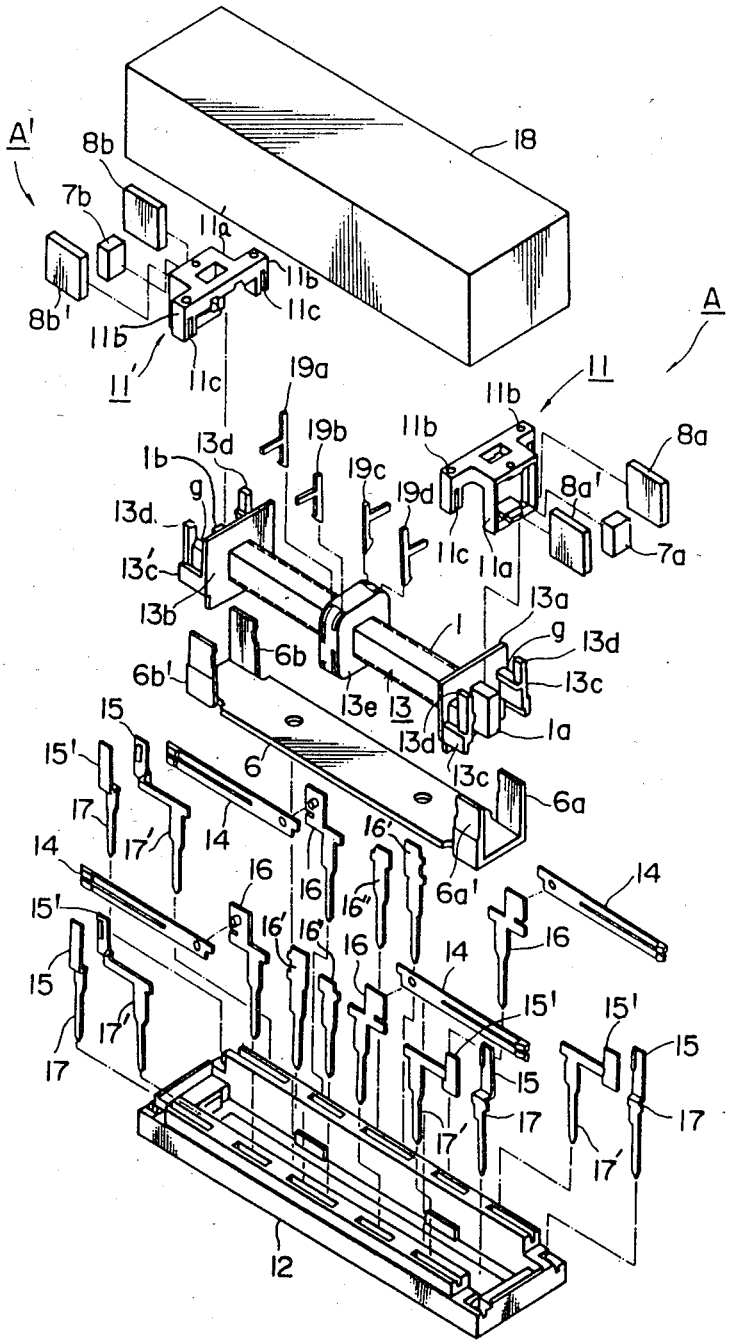
FIG. 1 is an exploded perspective view showing a polarized electromagnetic relay according to an embodiment of the present invention.

Now, the invention will be described in detail in conjunction with an exemplary embodiment shown in FIG. 1. In accordance with a general aspect of the polarized relay according to the illustrative embodiment, guide mechanisms for the movable magnetic blocks or armatures are provided, respectively, in collars formed at both ends of a coil spool into which an elongated core is inserted.

Referring to FIG. 1, the polarized electromagnetic relay is generally composed of a yoke 6, an iron core 1 and movable magnetic blocks or armatures A and A'. A pair of upstanding or erect lateral legs 6*a* and 6*a'* are formed integrally with the yoke 6 at one end in opposition to each other, while another pair of erect legs 6*b* and 6*b'* are formed at the other end of the yoke in the similar manner. The yoke 6 is adapted to be secured to a base plate 12. The iron core 1 having a generally I-like form and inserted in a coil spool 13 wound with a coil (not shown) is secured on the yoke 6 in such a manner in which one end portion 1*a* of core 1 is positioned between the upstanding legs 6*a* and 6*a'* with the other end portion 1*b* of the core 1 being positioned between the other pair of opposing legs 6*b* and 6*b'* of the yoke 6 so as to define four working gaps in total, i.e., first gap between 1*a* and 6*a*, second gap between 1*a* and 6*a'*, third gap between 1*b* and 6*b* and fourth gap between 1*b* and 6*b'*.

The armature A is constituted by a permanent magnet 7*a* fixedly sandwiched between pole piece plates 8*a* and 8*a'* having respective planes extending perpendicularly in the direction of magnetization of the permanent magnet 8*a*. The pole plates 8*a* and 8*a'* may be conveniently bonded to the permanent magnet 7*a*. In a similar manner, the armature A' is constituted by a permanent magnet 7*b* and pole plates 8*b* and 8*b'* . The armature A thus assembled is snugly fitted in a frame 11*a* of a movable block 11 formed of a non-magnetic material such as resin. Similarly, the armature A' is mounted in the frame 11*a'* of the other movable block 11'. In this way, a pair of armature units or blocks of the identical structure are realized.

The coil spool 13 has the collars 13*a* and 13*b* at both ends, respectively, from which the core pole ends 1*a* and 1*b* project outwardly, respectively. A pair of guide members 13*c* are mounted on the collar 13*a* in juxtaposition with the pole end 1*a* at both sides thereof. Similarly, another pair of guide members 13*c'* is mounted on the other collar 13*b* at both sides of the pole end 1*b* of the core 1. The outer surfaces of the upstanding legs 6*a*, 6*a'*, 6*b* and 6*b'* are dimensionally adapted to the inner surfaces of the guide members 13*c* and 13*c'*. These upstanding legs are disposed between the associated guide members so as to define the working gaps mentioned above in cooperation with the magnetic pole ends 1*a* and 1*b*, respectively. It goes without saying that the upstanding legs 6*a*; 6*a'* and 6*b*; 6*b'* constitute the counterpart magentic pole pieces for the magnetic poles 1*a* and 1*b* of the core 1, respectively. Each of the guide members 13*c* has an upstanding post 13*d* formed at the free end, wherein a guide groove g is formed between the posts 13*d* and the outer surface of the collar 13*a*. Identical guide structure is provided at the other collar 13*b*. On the other hand, each of the movable blocks 11 and 11' has laterally projecting arms 11*b* which are adaptively received by the guide groove g so that the movable blocks are laterally slideably supported on the associated guide members 13*c* and 13*c*'. Each of the arms 11*b* has a downwardly depending slit element in which a vertical slit 11*c* is formed. These slits 11*c* are adapted to receive, respectively, movable contact plates or arms 14 of the relay which are disposed at both sides of the core 1 and the coil, so that movement of the movable armature blocks A and A' brings about movement of the movable contact plates or arms 14 between respective stationary contacts 15 and 15'. Each of the relay switches is implemented in a single-pole double-throw configuration. The number of the relay switches is four in total. Each of the movable contact plates or arms 14 has one end rivetted to an associated terminal lug 16. Terminal lugs 17 for the stationary contacts as well as terminal lugs 16 for the movable contact arms are inserted through the base plate to constitute pins to be connected to a printed circuit.

Although the movable blocks 11 and 11' are supported by the slideable arms 11*b*, being simply placed on the respective guide grooves g, there is no possibility that the movable blocks 11 and 11' might be dismantled because the magnetic force acts among the pole plates 8*a*, 8*a*'; 8*b*, 8*b*', the pole ends 1*a* and 1*b* and the upstanding legs 6*a*, 6*a*'; 6*b*, 6*b*'. Additionally, by dimensioning a cover case 18 so that the distance between the ceiling of the case 18 and the top of the movable block 11 is small enough to prevent the movable blocks from jumping upon the sliding movement of the blocks, the movable blocks 11 and 11' are positively prevented from being disassembled.

The coil spool 13 is provided with a partition collar 13*e* at a midportion to divide the coil into two halves. One of the coil halves is electrically energized in such a direction in which the magnetic pole end 1*a* is polarized in N-polarity, while the other is energized so as to polarize the magnetic pole end 1*a* in the S-polarity. Reference symbols 19*a* to 19*d* denote terminal fixtures for securing the pair of the coil halves to the partition collar 13*e*. The elements 14, 15, 15', 16, 16', 17 and 17' constitute contact mechanisms with connector pins.

In the illustrative embodiment described above, the sliding guide grooves are formed in the collars of the coil spool. However, it is equally possible to form the corresponding grooves in the base plate or alternatively in the oppositely upstanding legs of the yoke.

With the structure of the polarized electromagnetic relay according to the invention in which the magnetic pole pieces of the movable armature blocks are positioned in the working gaps defined between the erect legs formed at both ends of the yoke and the magnetic pole ends of the core, the electromagnetic force of the permanent magnets, each constituting a part of the armature block, can be utilized with an increased efficiency to assure the high sensitivity of the polarized relay. Further, the armature blocks are not mutually linked but can move independent of each other. In other words, no swingable link member parallel to the core is required. Accordingly, a large space is available for winding the coil on the core by simply enlarging the distance between the core and the yoke. Thus, the polarized relay can be realized in a reduced size even when the number of turns of the coil is increased. Also, in the relay according to the invention in which the armatures can be moved independent of each other, perfectly flat contact can be realized between the pole elements mentioned above.

In the foregoing, the invention has been described in conjunction with the exemplary embodiment illustrated in the drawing. It should, however, be appreciated that many modifications and variations will readily occur to those skilled in the art without departing from the spirit and scope of the invention. Accordingly, the present invention is never restricted to the disclosure herein.

We claim:

1. A polarized electromagnetic relay, comprising:

an elongated yoke having at each end a pair of erect legs widthwise opposing to each other;

a bar-like core extending in parallel with said yoke;

a coil wound on said core; and a pair of movable armature blocks, each composed of a permanent magnet and a pair of magnetic pole pieces disposed at both ends thereof perpendicularly in the direction of magnetization of said permanent magnet;

wherein each end portion of said core is disposed between said paired erect legs, respectively, to thereby define four working gaps, said pair of the magnetic pole pieces of each movable armature block being disposed between each pair of said working gaps, and each of said armature blocks being slideably supported by guide means disposed on said core.

2. A polarized electromagnetic relay according to claim 1, further including a coil spool into which said core is inserted and on which said coil is wound, said coil spool having a pair of end collars, wherein said guide means is provided in each of said collars.

3. A polarized electromagnetic relay according to claim 2, further including a movable holder for holding said armature block, said holder being slideably placed on said guide means and operatively connected to movable contacts of the relay.

4. A polarized electromagnetic relay according to claim 2, wherein said coil spool is provided with a partition collar, said coil being divided into two halves adapted to be electrically energized independent of each other.

5. A polarized electromagnetic relay according to claim 1, wherein said guide means is provided on a base plate of the relay.

6. A polarized electromagnetic relay according to claim 1, wherein said guide means is provided at each pair of said legs of the yoke.

* * * * *